US011785676B2

(12) United States Patent
Lee et al.

(10) Patent No.: US 11,785,676 B2
(45) Date of Patent: Oct. 10, 2023

(54) COOKING APPARATUS AND COOKING SYSTEM INCLUDING THE SAME

(71) Applicant: LG Electronics Inc., Seoul (KR)

(72) Inventors: Jaewoo Lee, Seoul (KR); Hyunwook Moon, Seoul (KR); Hojae Seong, Seoul (KR)

(73) Assignee: LG Electronics Inc., Seoul (KR)

( * ) Notice: Subject to any disclaimer, the term of this patent is extended or adjusted under 35 U.S.C. 154(b) by 200 days.

(21) Appl. No.: 17/178,764

(22) Filed: Feb. 18, 2021

(65) Prior Publication Data

US 2021/0259058 A1 Aug. 19, 2021

(30) Foreign Application Priority Data

Feb. 18, 2020 (KR) ..... 10-2020-0019885

(51) Int. Cl.

| | |
|---|---|
| ***H05B 6/04*** | (2006.01) |
| ***H05B 6/06*** | (2006.01) |
| ***H05B 6/12*** | (2006.01) |

(52) U.S. Cl.

CPC ..... *H05B 6/04* (2013.01); *H05B 6/062* (2013.01); *H05B 6/1236* (2013.01); *H05B 6/1281* (2013.01)

(58) Field of Classification Search

CPC ..... H05B 6/062; H05B 6/04; H05B 6/1236; H05B 6/1281

See application file for complete search history.

(56) References Cited

U.S. PATENT DOCUMENTS

2018/0192479 A1* 7/2018 Kwack ..... H05B 6/062
2018/0317284 A1* 11/2018 Park ..... H05B 6/1272

FOREIGN PATENT DOCUMENTS

| | | |
|---|---|---|
| CN | 104869678 | 4/2017 |
| DE | 102010020189 | 1/2011 |
| EP | 3462816 | 4/2019 |
| WO | WO2019073574 | 7/2020 |

OTHER PUBLICATIONS

Extended European Search Report in European Appln. No. 21157855.4, dated Jul. 16, 2021, 4 pages.

* cited by examiner

*Primary Examiner* — Dana Ross
*Assistant Examiner* — Kuangyu Chen
(74) *Attorney, Agent, or Firm* — Fish & Richardson P.C.

(57) ABSTRACT

A cooking apparatus includes: a receiving coil configured to receive power wirelessly, a first rectifier configured to rectify power transmitted from the receiving coil, a first DC capacitor connected to an output terminal of the first rectifier, a working coil, an inverter, a second DC capacitor connected to an input terminal of the inverter, and a filter circuit connected between the first DC capacitor and the second DC capacitor and configured to block a noise current that flows between the first DC capacitor and the second DC capacitor and that is associated with a predetermined frequency or a frequency higher than the predetermined frequency. The inverter is configured to convert power from the second DC capacitor into an alternating current and transmit the converted alternating current to the working coil.

20 Claims, 9 Drawing Sheets

10

COOKING APPARATUS AND COOKING SYSTEM INCLUDING THE SAME

CROSS-REFERENCE TO RELATED APPLICATION

The present disclosure claims priority to and the benefit of Korean Patent Application No. 10-2020-0019885, filed on Feb. 18, 2020, in the Korean Intellectual Property Office, the disclosure of which is incorporated herein by reference in its entirety.

TECHNICAL FIELD

The present disclosure relates to a cooking apparatus and a cooking system including the same, and more particularly, to a cooking apparatus for limiting noise in the audible frequency band according to an operation of the cooking apparatus, and a cooking system including the same.

BACKGROUND

A cooking apparatus is one of household appliances for cooking food and can refer to an appliance that is installed in a kitchen to cook food according to a user's intention.

Among the cooking apparatus, the market size of electric ranges is gradually expanding. This is because the electric range does not generate carbon monoxide, and the risk of safety accidents such as gas leakage and fire is low.

Generally, the electric ranges include a Hi-Light type electric range and an induction type electric range. The Hi-Light type electric range converts electricity into heat by using a nichrome wire with high electrical resistance. The induction type electric range is a cooking heating device using the principle of induction heating that uses an electric magnetic field.

The induction type electric range generates a strong magnetic field line by passing a high-frequency current through a working coil provided therein. For example, when the magnetic field line, which are generated by the working coil passes through a cooking tool such as a metal pot, an eddy current is formed in the cooking tool. In addition, as the eddy current flows through the cooking tool, heat is generated so that the cooking tool itself is heated, and the contents of the cooking tool are also heated.

Recently, due to an increase in single-person households, the use of small-sized cooking apparatus for cooking small amounts of food, such as a mini-oven-type electric oven, has been increasing. Further, research on the small-sized cooking apparatus that operate by receiving power wirelessly has been actively conducted such that it is easy to change the location according to the user's convenience.

However, for a conventional induction type electric range, when the difference between the resonant frequency related to the wireless power supply and the frequency related to the operation of the working coil is included in the audible frequency range, noise is generated, causing inconvenience in use.

SUMMARY

The present disclosure is directed to a cooking apparatus and a cooking system including the same.

According to one aspect of the subject matter described in this application, a cooling apparatus includes a receiving coil configured to receive power wirelessly, a first rectifier configured to rectify power transmitted from the receiving coil, a first DC capacitor connected to an output terminal of the first rectifier, a working coil, an inverter, a second DC capacitor connected to an input terminal of the inverter, and a filter circuit connected between the first DC capacitor and the second DC capacitor and configured to block a noise current that flows between the first DC capacitor and the second DC capacitor and that is associated with a predetermined frequency or a frequency higher than the predetermined frequency. The inverter can be configured to convert power from the second DC capacitor into an alternating current and transmit the converted alternating current to the working coil.

Implementations according to this aspect can include one or more of the following features. For example, a difference between a first resonant frequency of a current flowing through the receiving coil and a second resonant frequency of a current flowing through the working coil can be within an audible frequency band.

In some examples, the difference between the first resonant frequency and the second resonant frequency can be within a frequency band of 1 kHz to 20 kHz. In some implementations, the filter circuit can include an inductor connected between the first DC capacitor and the second DC capacitor. In some examples, the predetermined frequency can be lower than the first resonant frequency or the second resonant frequency.

In some implementations, the cooking apparatus further comprises a second rectifier that includes an input terminal connected to a power supply and an output terminal connected to the second DC capacitor. In some examples, the cooking apparatus further includes a power cut-off unit that is disposed between the filter circuit and the second DC capacitor and that includes at least one switching element, and a controller configured to control the power cut-off unit based on power being supplied from the power supply.

In some implementations, the controller can be configured to control, based on the power being supplied from the power supply, the power cut-off unit to turn off the at least one switching element to cut off an electrical connection between the filter circuit and the second DC capacitor, and control, based on the power not being supplied from the power supply, the power cut-off unit to turn on the at least one switching element to connect the filter circuit to the second DC capacitor.

In some implementations, the cooking apparatus can further comprise a first resonator that includes a resonant capacitor connected in series to the receiving coil. A resonance frequency of power reception can be determined based on a capacitance of the first resonator. In some examples, the cooking apparatus further includes a second resonator that includes a plurality of resonance capacitors connected between the second DC capacitor and the working coil where capacitances of the plurality of resonance capacitors can be same.

According to another aspect of the subject matter described in this application, a cooking system includes a power supply device including a transmitting coil and configured to transmit power, and a cooking apparatus configured to wirelessly receive power from the power supply device. The cooking apparatus can further include a receiving coil configured to receive power wirelessly, a first rectifier configured to rectify power transmitted from the receiving coil, a first DC capacitor connected to an output terminal of the first rectifier, a working coil, an inverter, a second DC capacitor connected to an input terminal of the inverter, and a filter circuit connected between the first DC capacitor and the second DC capacitor and configured to block a noise current that flows between the first DC capacitor and the second DC capacitor and that is associated with a predetermined frequency or a frequency higher than the predetermined frequency. The inverter can be configured to convert power from the second DC capacitor into an alternating current and transmit the converted alternating current to the working coil.

Implementations according to this aspect can include one or more following features. For example, a difference between a first resonant frequency of a current flowing through the receiving coil and a second resonant frequency of a current flowing through the working coil can be within an audible frequency band.

In some implementations, the difference between the first resonant frequency and the second resonant frequency can be within a frequency band of 1 kHz to 20 kHz. In some examples, the filter circuit can include an inductor connected between the first DC capacitor and the second DC capacitor. In some implementations, the predetermined frequency can be a frequency lower than the first resonant frequency or the second resonant frequency.

In some implementations, the cooking apparatus can further comprise a second rectifier that includes an input terminal connected to a power supply and an output terminal connected to the second DC capacitor. In some examples, the cooking apparatus further includes a power cut-off unit that is disposed between the filter circuit and the second DC capacitor and that includes at least one switching element, and a controller configured to control the power cut-off unit based on power being supplied from the power supply.

In some implementations, the controller can be configured to control, based on the power being supplied from the power supply, the power cut-off unit to turn off the at least one switching element to cut off an electrical connection between the filter circuit and the second DC capacitor, and control, based on the power not being supplied from the power supply, the power cut-off unit to turn on the at least one switching element to connect the filter circuit to the second DC capacitor.

In some implementations, the cooking apparatus can further comprise a first resonator that includes a resonant capacitor connected in series to the receiving coil. A resonance frequency of power reception can be determined based on a capacitance of the first resonator. In some examples, the cooking apparatus can further comprise a second resonator that includes a plurality of resonance capacitors connected between the second DC capacitor and the working coil where capacitances of the plurality of resonance capacitors can be same.

DETAILED DESCRIPTION

Figure 1:
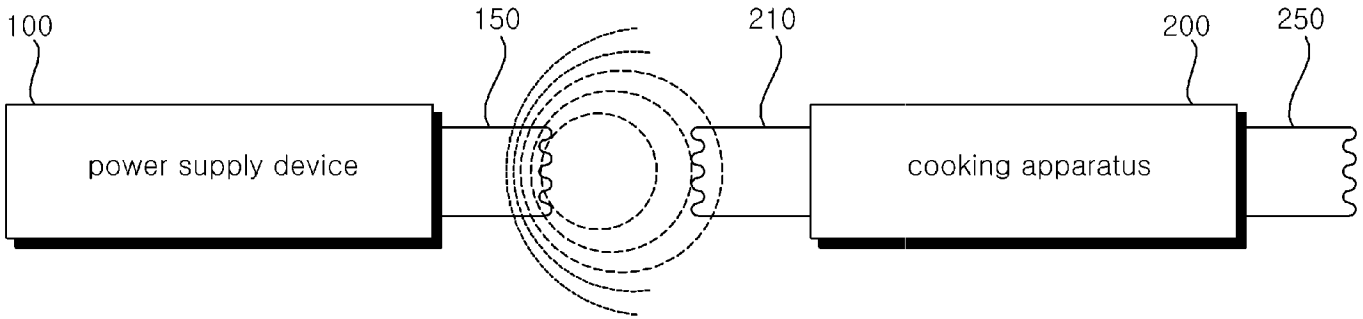
FIG. 1 is a diagram illustrating a block diagram of an exemplary cooking system.

FIG. 1 is a diagram illustrating a block diagram of an exemplary cooking system.

Referring to FIG. 1, the cooking system 10 can include a power supply device 100 for wirelessly transmitting power and a cooking apparatus 200 for receiving the transmitted power.

The power supply device 100 can wirelessly transmit power to the cooking apparatus 200 using a magnetic induction phenomenon in which a current is induced in at least one receiving coil 210 included in the cooking apparatus 200 according to a change in a magnetic line of force due to a current flowing through the at least one transmitting coil 150.

In some implementations, the power supply device 100 and the cooking apparatus 200 can use an electromagnetic induction method defined by Wireless Power Consortium (WPC) or Power Matters Alliance (PMA). In addition or alternatively, the power supply device 100 and the cooking apparatus 200 can use a magnetic resonance method defined in Alliance for Wireless Power (A4WP).

In some implementations, a single power supply device 100 can transmit power to a plurality of cooking apparatus 200. For example, the power supply device 100 can transmit power to the plurality of cooking apparatus 200 according to a time-division method, or transmit power to the plurality of cooking apparatus 200 by using different frequency bands allocated to each of the plurality of cooking apparatus 200. The number of cooking apparatus 200 receiving power from the single power supply device 100 can be adaptively determined in consideration of the amount of power required for each of the plurality of cooking apparatus 200 and the amount of available power of the power supply device 100.

The cooking apparatus 200 can perform an operation based on the power received from the power supply device 100. For example, the cooking apparatus 200 can cause a high-frequency current to flow through at least one working coil 250 based on the power received through the receiving coil 210.

The magnetic line of force, which is generated by the current flowing through the working coil 250, passes through a cooking tool such as a metal pot to provide an eddy current in the cooking tool. Further, as the eddy current flows in the cooking tool, the magnetic line of force can generate heat, thereby heating the cooking tool and contents placed in the cooking tool.

Figure 2:
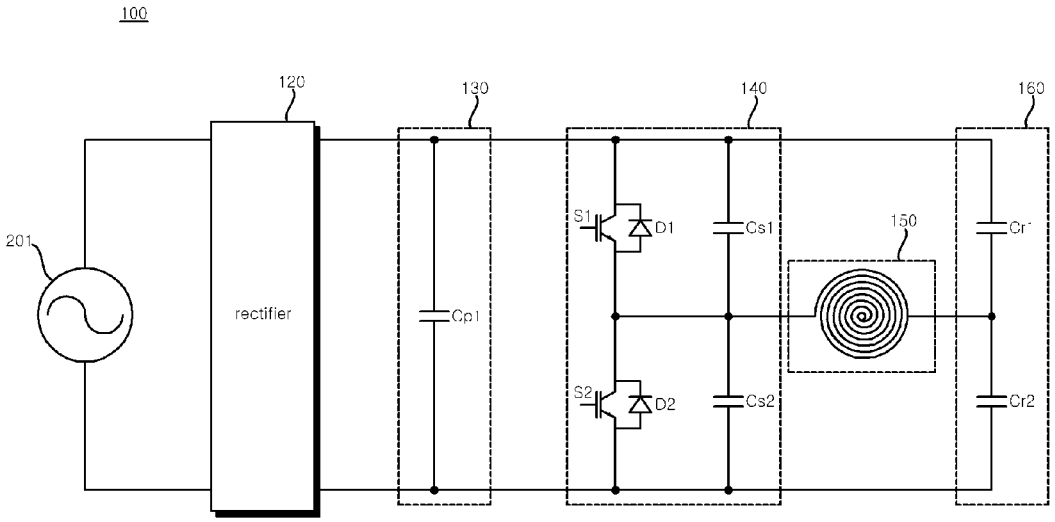
FIG. 2 is a diagram illustrating an internal circuit of an exemplary power supply device.

FIG. 2 is a diagram illustrating an internal circuit of the power supply device 100 in FIG. 1.

Referring to FIG. 2, the power supply device 100 can include a rectifier 120 connected to an external power source, a DC capacitor 130, an inverter 140, a transmitting coil 150, and/or a resonator 160.

The rectifier 120 can rectify power input from a commercial power supply 201, which is an external power source. The rectifier 120 can convert an alternating current (AC) voltage supplied through the commercial power supply 201 into a direct current (DC) voltage. For example, the commercial power supply 201 can be a single-phase AC power or a three-phase AC power.

The rectifier 120 can include a bridge diode having two or three pairs of upper arm diode elements and lower arm diode elements that are connected in series to each other. The rectifier 120 can further include a plurality of switching elements.

The DC capacitor 130 can be connected to a DC terminal, which is an output terminal of the rectifier 120, and can store DC power supplied from the rectifier 120. In some implementations, a plurality of element Cp1 can be provided as the DC capacitor 130 to ensure device stability.

The inverter 140 can include a plurality of switching elements S1 and S2. The inverter 140 can convert the DC power stored in the DC capacitor 130 into AC power of a predetermined frequency according to the operation of the switching elements S1 and S2 and output the converted AC power to the transmitting coil 150.

For example, when the switching elements S1 and S2 are insulated gate bipolar transistor (IGBT), driving signal generated by the pulse width modulation (PWM) signal can be input to the gate terminals of the switching elements S1 and S2. In this case, by turning on/off the switching elements S1 and S2 according to the driving signal, a high-frequency current can be output from the inverter 140 to flow through the transmitting coil 150.

For example, when the high-frequency current output from the inverter 140 flows through the transmitting coil 150, a magnetic field can be generated in the transmitting coil 150. In some implementations, a current of a predetermined frequency can be induced in the receiving coil 210 of the cooking apparatus 200 by the magnetic field generated by the transmitting coil 150.

The inverter 140 can further include a plurality of snubber capacitors Cs1 and Cs2. The plurality of snubber capacitors Cs1 and Cs2 can be connected to the plurality of switching elements S1 and S2, respectively.

The snubber capacitors Cs1 and Cs2 can be included to reduce the inrush current or transient voltage generated in the switching elements S1 and S2 and can remove electromagnetic noise.

In some implementations, by adjusting a saturation voltage increase rate while the switching elements S1 and S2 are turned off, the snubber capacitors Cs1 and Cs2 can affect the energy loss during the turn-off.

The transmitting coil 150 can have a round shape, a circular sector shape, or a polygonal shape such as a triangular shape or a square shape, but its shape is not limited thereto.

The resonator 160 can include a plurality of capacitors Cr1 and Cr2 connected between the DC terminal and the transmitting coil 150. For example, the capacitances of the first resonance capacitor Cr1 and the second resonance capacitor Cr2 can be the same.

For example, the first resonance capacitor Cr1 can have a first end connected to a first end of the DC capacitor 130 and a second end connected to a node to which the second resonance capacitor Cr2 and the transmitting coil 150 are connected. By way of further example, the second resonance capacitor Cr2 can have a first end connected to a second end of the DC capacitor 130 and a second end connected to a node to which the first resonance capacitor Cr1 and the transmitting coil 150 are connected.

The resonant frequency of power transmission can be determined according to the capacitance of the resonator 160. For example, the resonant frequency of power transmission can be determined according to the inductance of the transmitting coil 150 and the capacitance of the resonator 160.

A resonance curve can be formed around the resonant frequency determined by the inductance of the transmitting coil 150 and the capacitance of the resonator 160. For example, the resonance curve can be a curve representing output power according to frequency.

According to the inductance of the transmitting coil 150 and the capacitance of the resonator 160, a quality factor Q can be determined, and the resonance curve can be formed differently according to the quality factor Q. Accordingly, according to the inductance of the transmitting coil 150 and the capacitance of the resonator 160, the power supply device 100 can have different output characteristics, and the frequency at which the maximum power is output can be referred to as the resonant frequency.

Figure 3:
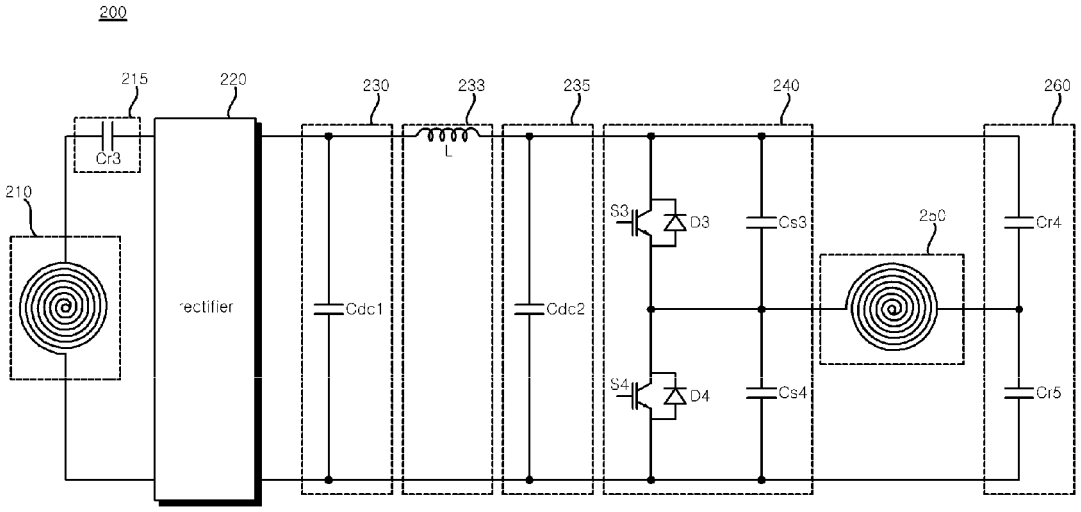
FIG. 3 is a diagram illustrating an internal circuit of the exemplary cooking apparatus of FIG. 1.

FIG. 3 is a diagram illustrating an internal circuit of the exemplary cooking apparatus 200 of FIG. 1.

Referring to FIG. 3, the cooking apparatus 200 can include a receiving coil 210, a first resonator 215, a rectifier 220, a first DC capacitor 230, a filter circuit 233, a second DC capacitor 235, an inverter 240, a working coil 250 and/or a second resonator 260.

The receiving coil 210 can receive power transmitted from the power supply device 100. For example, a current of a predetermined frequency can be induced in the receiving coil 210 by a magnetic field generated in the transmitting coil 150 of the power supply device 100, and induced electromotive force according to the induced current can be supplied as power for the operation of the cooking apparatus 200.

The first resonator 215 can include a third resonant capacitor Cr3 for forming a resonant circuit with the power supply device 100. The third resonance capacitor Cr3 can be connected in series to the receiving coil 210.

The resonant frequency of power reception can be determined according to the capacitance of the first resonator 215. For example, the resonant frequency of power reception can be determined according to the inductance of the receiving coil 210 and the capacitance of the first resonator 215.

In some implementations, the resonant frequency of power transmission and the resonant frequency of power reception can be the same, and an induced current having the same frequency as the frequency of the current flowing through the transmitting coil 150 can flow through the receiving coil 210.

The rectifier 220 can rectify power delivered from the receiving coil 210. The rectifier 220 can convert an alternating current induced in the receiving coil 210 by a magnetic field generated in the transmitting coil 150 into a direct current.

The rectifier 220 can include a bridge diode, and can further include a plurality of switching elements.

An element included in the rectifier 220 of the cooking apparatus 200 can be different from an element included in the rectifier 120 of the power supply device 100. For example, the element included in the rectifier 220 of the cooking apparatus 200 can be a device corresponding to a high frequency (e.g. 32 kHz) power transmitted through the receiving coil 210, and the element included in the rectifier 120 of the power supply device 100 can be a device corresponding to a low frequency (e.g. 60 Hz) power supplied through the commercial power supply 201.

The first DC capacitor 230 can be connected to a DC terminal, which is an output terminal of the rectifier 220, and can store DC power supplied from the rectifier 220.

The second DC capacitor 235 can be connected to the input terminal of the inverter 240. In some implementations, one or more elements Cdc1 and Cdc2 can be provided as DC capacitors 230 and 235.

The inverter 240 can include a plurality of switching elements S3 and S4. The inverter 240 can convert the DC power stored in the second DC capacitor 235 into AC power of a predetermined frequency and output the converted AC power to the working coil 250.

For example, a magnetic line of force generated by a high-frequency current flowing through the working coil 250 can pass through the cooking tool when a high-frequency current output from the inverter 240 flows through the working coil 250 while a cooking tool such as a metal pot is located close to the working coil 250. By way of further example, an eddy current can be provided in the cooking tool by magnetic lines of force passing through the cooking tool, and heat can be generated by the eddy current formed in the cooking tool to heat the cooking tool.

The second resonator 260 can include a plurality of capacitors Cr4 and Cr5 connected between the second DC capacitor 235 and the working coil 250. In some implementations, the capacitances of the fourth resonance capacitor Cr4 and the fifth resonance capacitor Cr5 can be the same. For example, the fourth resonance capacitor Cr4 can have a first end connected to a first end of the second DC capacitor 235 and a second end connected to a node to which the fifth resonance capacitor Cr5 and the working coil 250 are connected. By way of further example, the fifth resonance capacitor Cr5 can have a first end connected to a second end of the second DC capacitor 235 and a second end connected to a node to which the fourth resonance capacitor Cr4 and the working coil 250 are connected.

The resonant frequency related to the operation of the working coil 250 can be determined according to the capacitance of the second resonator 260. For example, the resonant frequency related to the operation of the working coil 250 can be determined according to the inductance of the working coil 250 and the capacitance of the second resonator 260.

In some implementations, a difference between the resonant frequency of the current flowing through the receiving coil 210 and the resonant frequency of the current flowing through the working coil 250 can be included in the audible frequency band.

For example, the difference between the resonant frequency of the current flowing through the receiving coil 210 (e.g. 32 kHz) and the resonant frequency of the current flowing through the working coil 250 (e.g. 41 kHz) can be included in a frequency band of 1 kHz or more, and less than 20 kHz.

The filter circuit 233 can block a noise current flowing between the first DC capacitor 230 and the second DC capacitor 235.

The noise current blocked through the filter circuit 233 can be a high-frequency current having a predetermined frequency or higher. In some implementations, the predetermined frequency that is the reference of the noise current can be a frequency smaller than the resonant frequency of power reception (e.g. 32 kHz) and the resonant frequency related to the operation of the working coil 250 (e.g. 41 kHz).

The filter circuit 233 can include at least one inductor L, and the inductor L can be connected between the first DC capacitor 230 and the second DC capacitor 235. In some implementations, among the components included in the current output from the rectifier 220 or the current output from the inverter 240, a low frequency component can be induced to flow through the inductor L and a high frequency component can be induced to flow through the capacitors Cdc1 and Cdc2.

In some implementations, the inductance of the inductor L included in the filter circuit 233 can be determined based on the predetermined frequency that is a reference of the noise current to be blocked, a degree of decrease in magnetic permeability of the inductor L, a degree of saturation in magnetic permeability of the inductor L, etc.

For example, the inductance of the inductor L included in the filter circuit 233 can be set to block a noise current having a frequency equal to or higher than a frequency corresponding to the smaller of the resonant frequency of power reception (e.g. 32 kHz) and the resonant frequency related to the operation of the working coil 250 (e.g. 41 kHz).

Figure 4A:
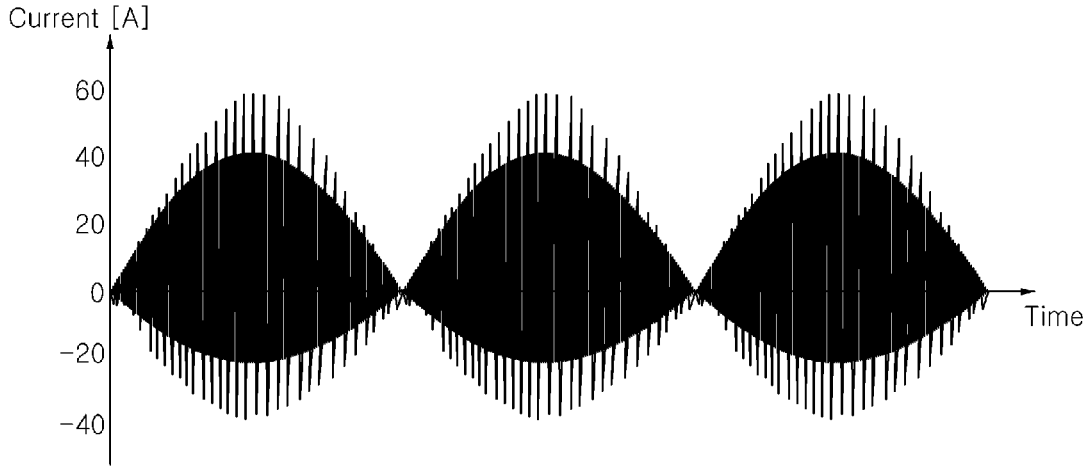
FIGS. 4A and 4B are diagrams referred to in explaining an operation of a cooking apparatus.

Referring to FIG. 4A, when the cooking apparatus 200 does not include the filter circuit 233, a current including the noise current of the high frequency component can flow between the rectifier 220 and the inverter 240.

Figure 4B:
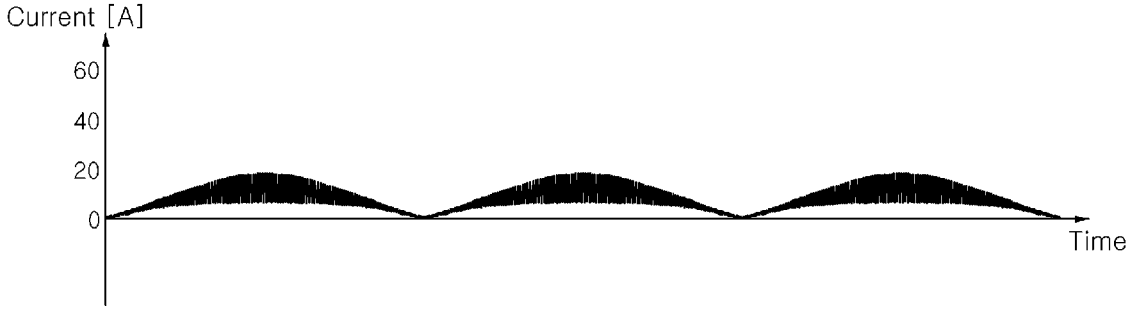

On the other hand, referring to FIG. 4B, when the cooking apparatus 200 includes the filter circuit 233, only a current of the low frequency component, which does not include the noise current of the high frequency component that may cause noise in the audible frequency band, can flow between the rectifier 220 and the inverter 240.

As described above, since the cooking apparatus 200 includes the filter circuit 233, the high-frequency current flowing through the receiving coil 210 and the rectifier 220 can be blocked from flowing toward the inverter 240 and the working coil 250, and the high-frequency current flowing through the inverter 240 and the working coil 250 can be blocked from flowing toward the receiving coil 210 and the rectifier 220. As such, an occurrence of noise in the audible frequency band due to the difference between the resonant frequency for the transmission and reception of power and the resonant frequency for the operation of the working coil 250 can be limited.

Figure 5:
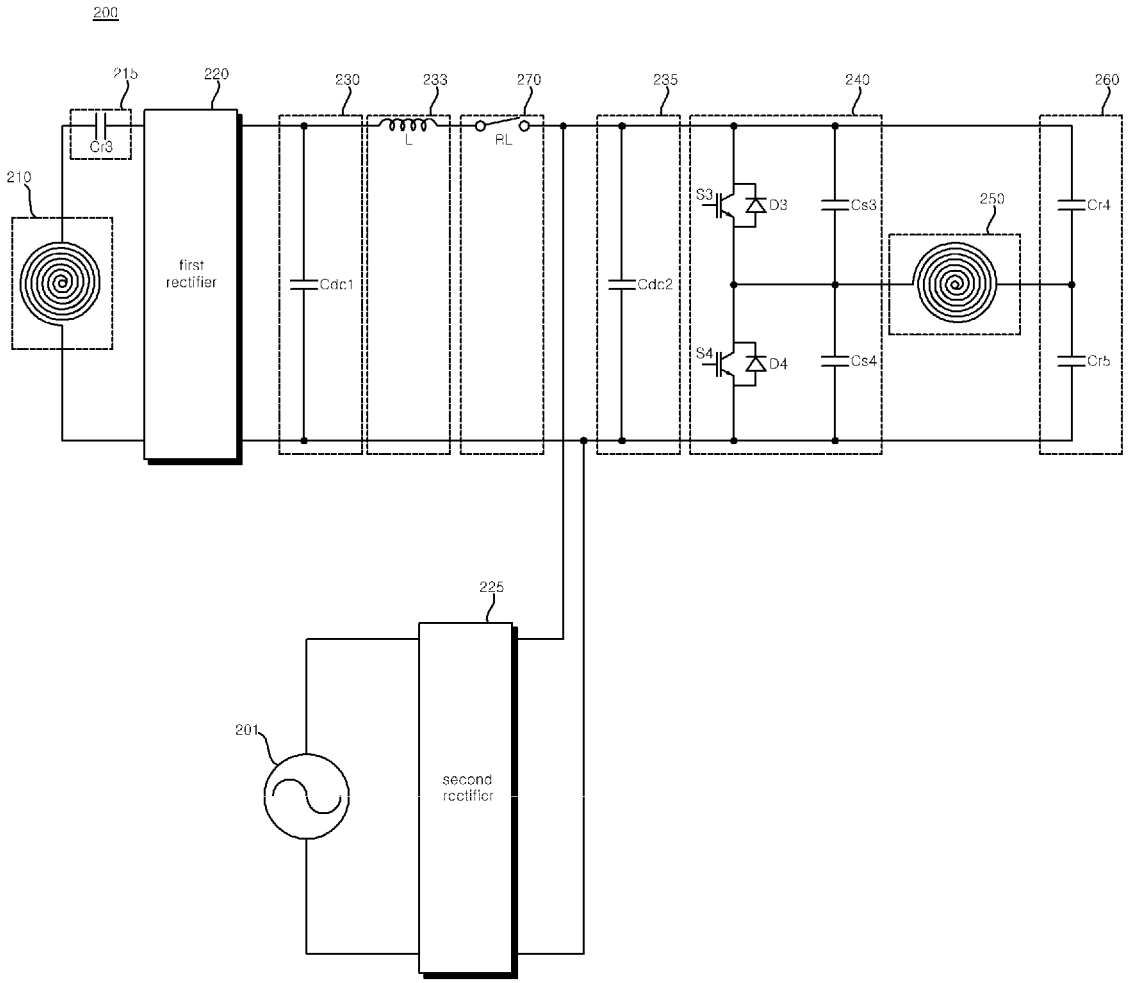
FIG. 5 is a block diagram illustrating an exemplary cooking apparatus.
Figure 6A:
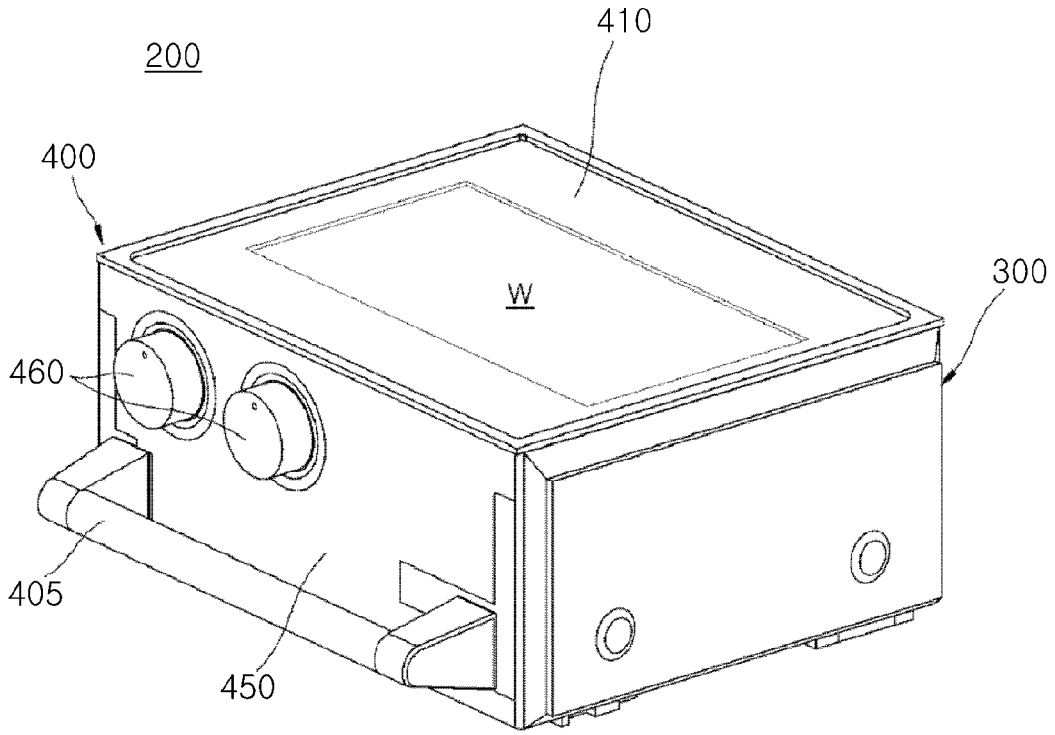
FIGS. 6A to 6D are diagrams referred to in explaining an implementation of an exemplary cooking apparatus.
Figure 6B:
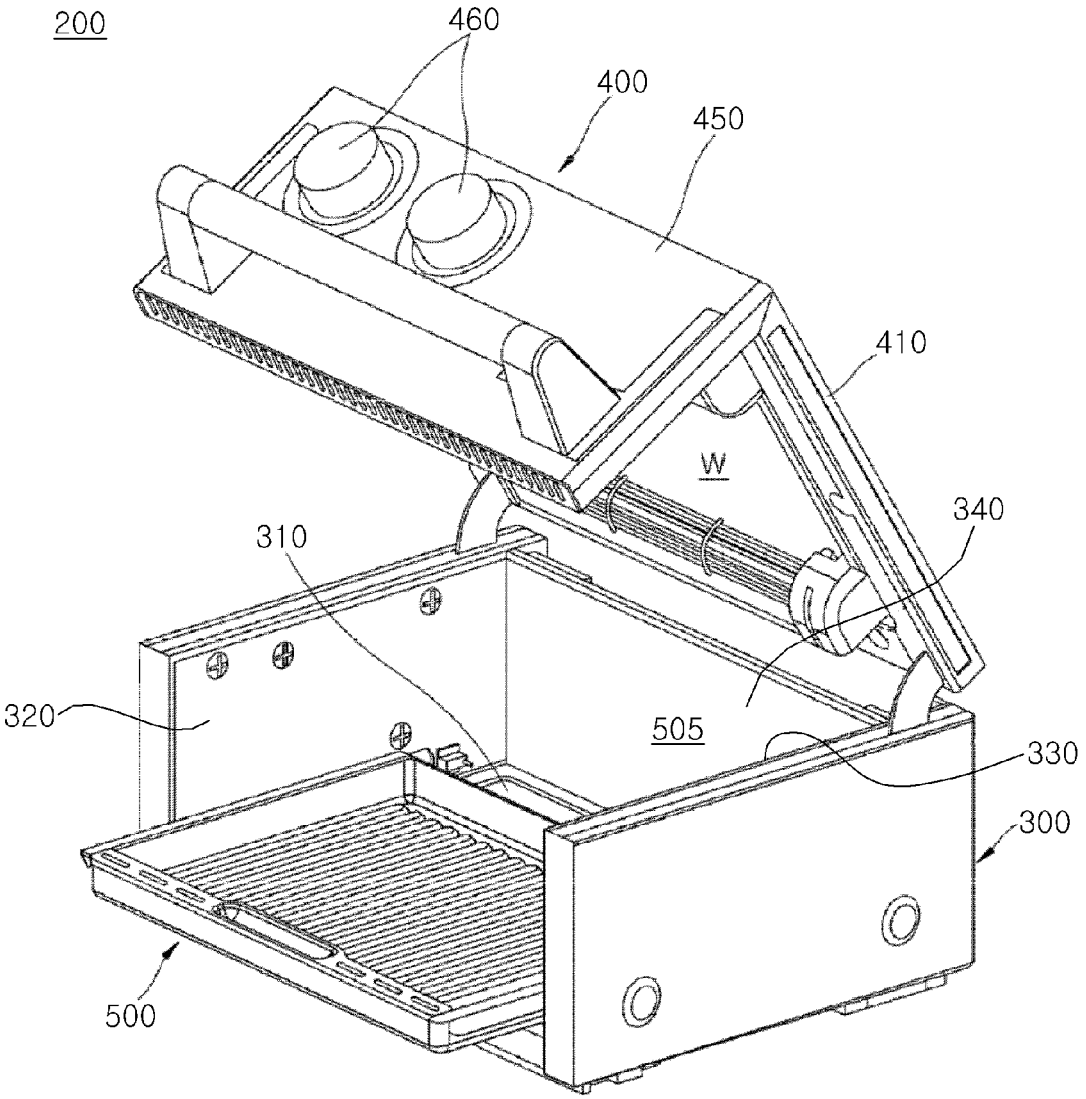
Figure 6C:
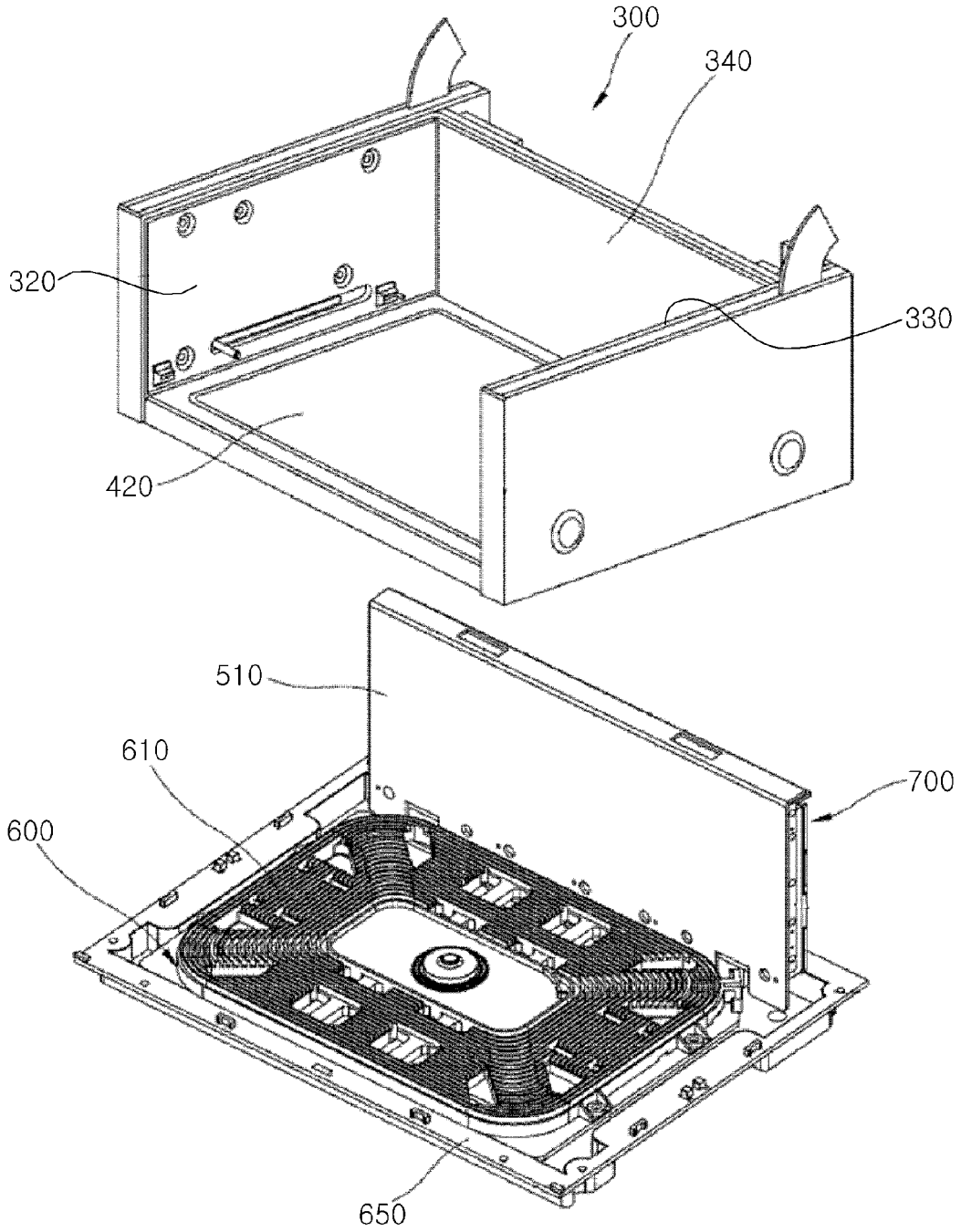
Figure 6D:
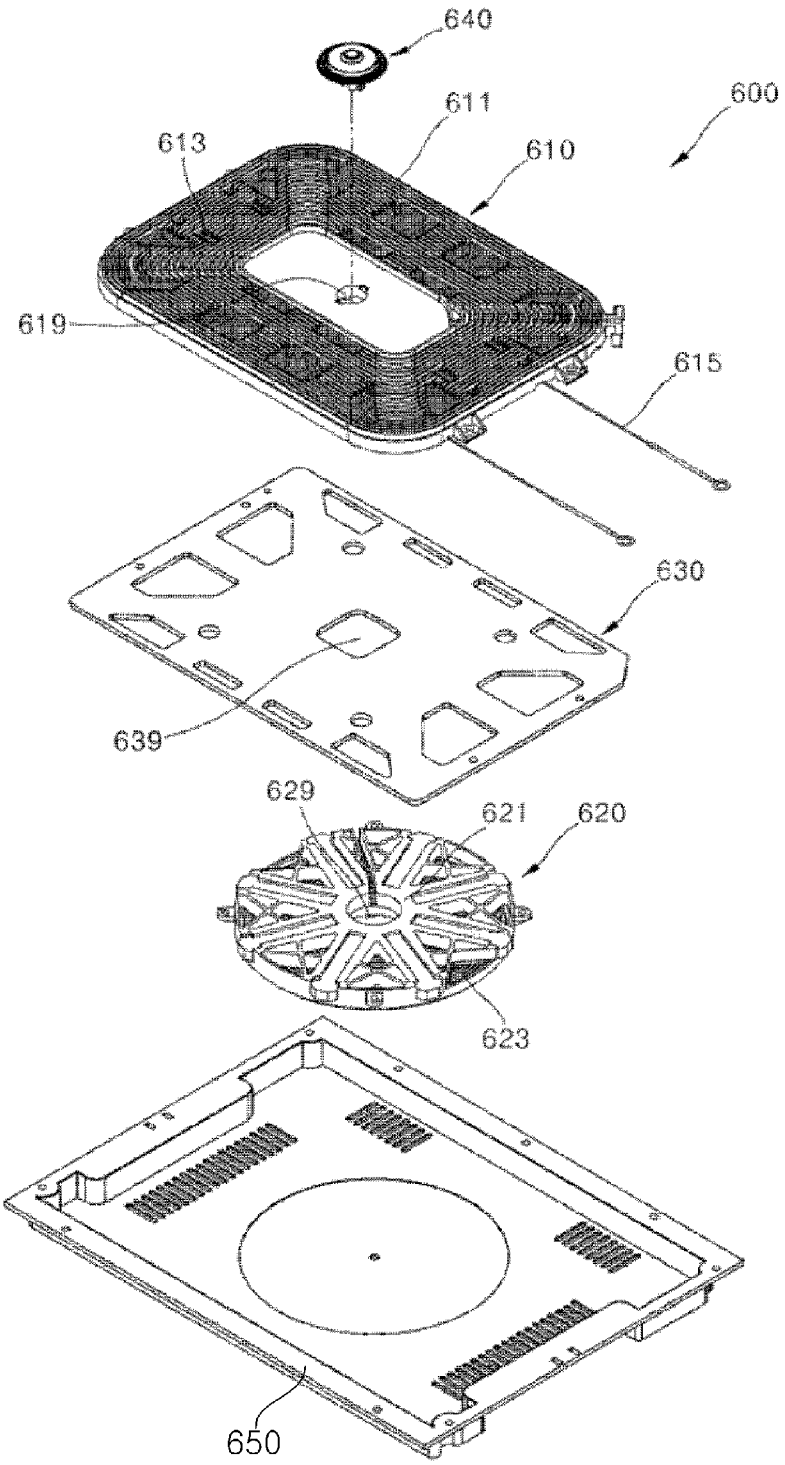

FIG. 5 is a block diagram illustrating an exemplary cooking apparatus.

Referring to FIG. 5, the cooking apparatus 200 can include the receiving coil 210, the first resonator 215, the first rectifier 220, a second rectifier 225, the first DC capacitor 230, the filter circuit 233, the second DC capacitor 235, the inverter 240, the working coil 250, the second resonator 260 and/or a power cut-off unit 270.

The receiving coil 210 can receive power transmitted from the power supply device 100.

The first resonator 215 can include a third resonant capacitor Cr3 for forming a resonant circuit with the power supply device 100. The third resonance capacitor Cr3 can be connected in series to the receiving coil 210.

The first rectifier 220 can rectify power delivered from the receiving coil 210. The first rectifier 220 can convert an alternating current induced in the receiving coil 210.

The first DC capacitor 230 may be connected to the DC terminal, which is the output terminal of the first rectifier 220, and may store DC power supplied from the first rectifier 220.

The second DC capacitor 235 can be connected to an input terminal of the inverter 240.

The inverter 240 can include a plurality of the switching elements S3 and S4. The inverter 240 can convert the DC power stored in the second DC capacitor 235 into AC power of a predetermined frequency and output the converted AC power to the working coil 250.

The second resonator 260 can include a plurality of the capacitors Cr3 and Cr4 connected between the second DC capacitor 235 and the working coil 250. For example, the capacitances of the fourth resonance capacitor Cr4 and the fifth resonance capacitor Cr5 can be the same.

The filter circuit 233 can block a noise current flowing between the first DC capacitor 230 and the second DC capacitor 235.

The filter circuit 233 can include the at least one inductor L, and the inductor L can be connected between the first DC capacitor 230 and the second DC capacitor 235.

The second rectifier 225 can be connected to the commercial power supply 201 which is the external power supply. The second rectifier 225 can rectify AC power input from the commercial power supply 201 and output it to the second DC capacitor 235. The second rectifier 225 can convert an AC voltage supplied through the commercial power supply 201 into a DC voltage. For example, the commercial power supply 201 can be a single-phase AC power or a three-phase AC power.

An element included in the first rectifier 220 can be different from an element included in the second rectifier 225. For example, the element included in the first rectifier 220 can be a device corresponding to a high frequency (e.g. 32 kHz) power transmitted through the receiving coil 210, and the element included in the second rectifier 225 can be a device corresponding to a low frequency (e.g. 60 Hz) power supplied through the commercial power supply 201.

The power cut-off unit 270 can be connected to the second DC capacitor 235 and can cut off the supply of power transmitted from the receiving coil 210 to the second DC capacitor 235. For example, the power cut-off unit 270 can be connected between the filter circuit 233 and the second DC capacitor 235.

The power cut-off unit 270 can include at least one switching element RL. In some implementations, the switching element RL can be a relay that is turned on/off based on a current flowing through a coil.

The cooking apparatus 200 can further include a controller connected to each component included in the cooking apparatus 200 and controlling an operation of each component.

The controller can check whether power is supplied through the commercial power supply 201. In some implementations, the cooking apparatus 200 can further include a power detection unit that detects power supplied through the commercial power supply 201. The power detection unit can be connected to an input terminal and/or an output terminal of the second rectifier 225.

For example, when power is supplied from the commercial power supply 201, the controller can control the switching element RL included in the power cut-off unit 270 to be turned off so that the power transmitted from the receiving coil 210 to the second DC capacitor 235 is cut off.

By way of further example, when power is not supplied from the commercial power supply 201, the controller can control the switching element RL included in the power cut-off unit 270 to be turned on so that power is supplied from the receiving coil 210 to the second DC capacitor 235.

As described above, the second DC capacitor 235 can serve to induce a flow of the noise current when power is wirelessly supplied from the power supply device 100, and can store the DC power when power is supplied from the commercial power supply 201. Through this, the cooking apparatus 200 can be supplied with power through various methods simply by additionally including a diode element and a switching element.

FIGS. 6A to 6D are diagrams referred to in explaining an implementation of an exemplary cooking apparatus.

Referring to FIGS. 6A to 6D, the cooking apparatus 200 can include a housing 300, a door 400, a tray 500, and a heating unit 600.

The housing 300 can form an exterior of the cooking apparatus 200. Several components constituting the cooking apparatus 200 can be respectively disposed in the housing 300, and a cooking chamber 505 can be provided in the housing 300 to provide a space for cooking food.

In some implementations, the housing 300 can have a hexahedral shape with an open top and a front surface, but the shape of housing 300 is not limited thereto.

The cooking apparatus 200 can define a space corresponding to the cooking chamber 505 inside the housing 300 surrounded by the bottom surface 310, both side surfaces 320 and 330, and the rear surface 340. The cooking apparatus 200 can be configured in a form in which an upper surface and a front surface can be opened.

For example, the housing 300 can constitute the exterior of the bottom surface 310, both sides 320 and 330, and the rear surface 340 of the cooking apparatus 200, and the door 400 can configure the top and front exteriors of the cooking apparatus 200.

In some implementations, the door 400 can have a door upper surface portion 410 and a door front surface portion 450.

The door upper surface portion 410 forming the upper surface of the door 400 may correspond to a configuration that covers the upper surface of the housing 300 when the door 400 closes the cooking chamber 505 inside the housing 300.

The door front surface portion 450 forming the front of the door 400 can correspond to a configuration that covers the opened front surface of the housing 300 when the door 400 closes the cooking chamber 505.

A handle 405 can be disposed on the front of the door 400, and a user can open and close the cooking chamber 505 by holding the handle 405 and rotating the door 400 in the vertical direction.

An input unit 460 can include various switches for controlling the operation of the cooking apparatus 200. For example, the input unit 460 can include an operation switch for on/off of the heating unit 600 or heat control, a switch for adjusting an operating time of the heating unit 600, and the like.

The input unit 460 can be provided to be exposed to the door front surface portion 450, and a user can directly manipulate the input unit 460 to control the operation of the cooking apparatus 200.

The door 400 can include a see-through window W. The see-through window W is disposed on the door upper surface portion 410 and can be located at a central portion of the door upper surface portion 410 in the plane direction. The user can look down on the inside of the cooking chamber 505 through the see-through window W from above, and through this, can check the cooking a state of food in the cooking chamber 505.

The tray 500 can be disposed in the cooking chamber 505 formed inside the housing 300. The tray 500 may be detachably formed inside the cooking chamber 505.

In addition, the tray 500 can be provided to be pulled out to the front of the cooking chamber 505 for user convenience. The tray 500 can be formed to be movable in the front-rear direction by interlocking with the opening/closing operation of the door 400.

The heating unit 600 can be disposed inside the housing 300 to heat the tray 500 disposed in the cooking chamber 505.

The heating unit 600 can include a working coil 610 (e.g. a working coil 250) disposed under the bottom surface 310 of the housing 300 and configured to control a high-frequency current to flow through the working coil 610.

A magnetic line of force generated by a high-frequency current flowing through the working coil 610 can pass through the tray 500, and an eddy current can be formed in the tray 500 by the magnetic line of force passing through the tray 500. Further, as the tray 500 is heated by the eddy current formed in the tray 500, the food in the tray 500 can also be heated. To this end, the tray 500 can be formed of a material capable of induction heating by the heating unit 600.

The working coil 610 can include a first base 611. In some implementations, the first base 611 can have a square that is close to the shape of the tray 500.

A groove can be provided in the upper part of the first base 611. The first coil 613 can be disposed in the groove provided on the first base 611 and can be tightly wound and fixed on the first base 611.

At an end of the first coil 613, a first connection wiring 615 connected to a coil control PCB for controlling the first coil 613 can be provided. A high-frequency current can flow through the first connection wiring 615 to the first coil 613.

The heating unit 600 can further include a receiving coil 620 (e.g. a receiving coil 210).

The receiving coil 620 can be configured to receive power transmitted wirelessly and can be disposed under the heating unit 600.

A base 650 can be disposed under the receiving coil 620. The base 650 can be coupled to the bottom surface 310 of the housing 300 to support the working coil 610, and can support the working coil 610, the receiving coil 620, and the like under the receiving coil 620. The base 650 can form an exterior of the bottom surface of the cooking apparatus 200.

The receiving coil 620 can include a second base 621 and a second coil 623 like the working coil 610. In some implementations, the second base 621 of the receiving coil 620 can have a circular shape different from the shape of the first base 611 of the working coil 610.

The heating unit 600 can further include a shielding plate 630 disposed between the working coil 610 and the receiving coil 620. The shielding plate 630 can be made of a metal material such as aluminum. The shielding plate 630 can minimize the effect of the EMI caused by the working coil 610 on the receiving coil 620 and the effect of the EMI caused by the receiving coil 620 on the working coil 610.

For example, the shielding plate 630 can block electromagnetic fields and electromagnetic waves located in the space above the shielding plate 630 from affecting the lower space of the shielding plate 630. Further, the shielding plate 630 can block electromagnetic fields and electromagnetic waves existing in a space lower than the shielding plate 630 from affecting the upper space of the shielding plate 630.

The heating unit 600 can further include a temperature sensor 640. The temperature sensor 640 can measure the temperature of the tray 500 or the temperature inside the cooking chamber 505 in which the tray 500 is disposed.

The heating unit 600 can be configured such that the centers of the working coil 610, the receiving coil 620, and the shielding plate 630 are all aligned.

For example, a first central hole 619 can be provided in the center of the working coil 610, a second central hole 629 can be provided at the center of the receiving coil 620, and a third central hole 639 can be provided in the center of the shielding plate 630.

According to the implementations of the present disclosure, an occurrence of noise from the difference between the resonant frequency of wireless power transmission and reception and the frequency of the current flowing through the working coil 250 can be limited, thereby improving user satisfaction and product reliability.

Further, since relatively simple circuit materials such as capacitors and inductors can be used to limit the noise, the implementation is easy, and cost is also low.

What is claimed is:

1. A cooking apparatus comprising:

a receiving coil configured to receive power wirelessly;

a rectifier configured to rectify power transmitted from the receiving coil;

an inverter configured to convert power from the rectifier into an alternating current a working coil electrically connected to an output terminal of the inverter from which the alternating current is output;

a first DC capacitor electrically connected to an output terminal of the rectifier;

a second DC capacitor electrically connected to an input terminal of the inverter; and a filter circuit electrically connected between the first DC capacitor and the second DC capacitor and configured to block a noise current that flows between the first DC capacitor and the second DC capacitor and that is associated with a predetermined frequency or a frequency higher than the predetermined frequency.

2. The cooking apparatus according to claim 1, wherein a difference between a first resonant frequency of a current flowing through the receiving coil and a second resonant frequency of a current flowing through the working coil is within an audible frequency band.

3. The cooking apparatus according to claim 2, wherein the difference between the first resonant frequency and the second resonant frequency is within a frequency band of 1 kHz to 20 kHz.

4. The cooking apparatus according to claim 3, wherein the filter circuit includes an inductor connected between the first DC capacitor and the second DC capacitor.

5. The cooking apparatus according to claim 4, wherein the predetermined frequency is lower than the first resonant frequency or the second resonant frequency.

6. The cooking apparatus according to claim 5, further comprising a second rectifier that includes an input terminal connected to a power supply and an output terminal connected to the second DC capacitor.

7. The cooking apparatus according to claim 6, further comprising:

a power cut-off unit that is disposed between the filter circuit and the second DC capacitor and that includes at least one switching element; and a controller configured to control the power cut-off unit based on power being supplied from the power supply.

8. The cooking apparatus according to claim 7, wherein the controller is configured to:

control, based on the power being supplied from the power supply, the power cut-off unit to turn off the at least one switching element to cut off an electrical connection between the filter circuit and the second DC capacitor, and control, based on the power not being supplied from the power supply, the power cut-off unit to turn on the at least one switching element to connect the filter circuit to the second DC capacitor.

9. A cooking system comprising:

a power supply device including a transmitting coil and configured to transmit power; and a cooking apparatus configured to wirelessly receive power from the power supply device, wherein the cooking apparatus comprises:

a receiving coil configured to receive power wirelessly;

a rectifier configured to rectify power transmitted from the receiving coil;

an inverter configured to convert power from the rectifier into an alternating current a working coil electrically connected to an output terminal of the inverter from which the alternating current is output;

a first DC capacitor electrically connected to an output terminal of the rectifier;

a second DC capacitor electrically connected to an input terminal of the inverter; and a filter circuit electrically connected between the first DC capacitor and the second DC capacitor and configured to block a noise current that flows between the first DC capacitor and the second DC capacitor and that is associated with a predetermined frequency or a frequency higher than the predetermined frequency.

10. The cooking system according to claim 9, wherein a difference between a first resonant frequency of a current flowing through the receiving coil and a second resonant frequency of a current flowing through the working coil is within an audible frequency band.

11. The cooking system according to claim 10, wherein the difference between the first resonant frequency and the second resonant frequency is within a frequency band of 1 kHz to 20 kHz.

12. The cooking system according to claim 11, wherein the filter circuit includes an inductor connected between the first DC capacitor and the second DC capacitor.

13. The cooking system according to claim 12, wherein the predetermined frequency is a frequency lower than the first resonant frequency or the second resonant frequency.

14. The cooking system according to claim 13, wherein the cooking apparatus further comprises a second rectifier that includes an input terminal connected to a power supply and an output terminal connected to the second DC capacitor.

15. The cooking system according to claim 14, wherein the cooking apparatus further comprises:

a power cut-off unit that is disposed between the filter circuit and the second DC capacitor and that includes at least one switching element; and a controller configured to control the power cut-off unit based on power being supplied from the power supply.

16. The cooking system according to claim 15, wherein the controller is configured to:

control, based on the power being supplied from the power supply, the power cut-off unit to turn off the at least one switching element to cut off an electrical connection between the filter circuit and the second DC capacitor, and control, based on the power not being supplied from the power supply, the power cut-off unit to turn on the at least one switching element to connect the filter circuit to the second DC capacitor.

17. The cooking apparatus according to claim 1, further comprising:

a first resonator that includes a resonant capacitor connected in series to the receiving coil, wherein a resonance frequency of power reception is determined based on a capacitance of the first resonator.

18. The cooking apparatus to claim 17, further comprising:

a second resonator that includes a plurality of resonance capacitors connected between the second DC capacitor and the working coil, wherein capacitances of the plurality of resonance capacitors are same.

19. The cooking system according to claim 9, wherein the cooking apparatus further comprises:

a first resonator that includes a resonant capacitor connected in series to the receiving coil, wherein a resonance frequency of power reception is determined based on a capacitance of the first resonator.

20. The cooking system according to claim 19, wherein the cooking apparatus further comprises:

a second resonator that includes a plurality of resonance capacitors connected between the second DC capacitor and the working coil, wherein capacitances of the plurality of resonance capacitors are same.

* * * * *